US008106575B2

(12) United States Patent
Hashizume

(10) Patent No.: US 8,106,575 B2
(45) Date of Patent: Jan. 31, 2012

(54) ELECTRON BEAM APPARATUS HAVING A RECESS FORMED IN A SURFACE OF AN INSULATING MEMBER

(75) Inventor: Yohei Hashizume, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 155 days.

(21) Appl. No.: 12/572,850

(22) Filed: Oct. 2, 2009

(65) Prior Publication Data

US 2010/0084961 A1 Apr. 8, 2010

(30) Foreign Application Priority Data

Oct. 3, 2008 (JP) ..... 2008-258014

(51) Int. Cl.
*H01J 29/46* (2006.01)
*H01J 1/62* (2006.01)

(52) U.S. Cl. ..... 313/448; 313/497
(58) Field of Classification Search ..... None
See application file for complete search history.

(56) References Cited

U.S. PATENT DOCUMENTS 6,992,428 B2 * 1/2006 Kyogaku et al. ..... 313/310

FOREIGN PATENT DOCUMENTS

JP 2001-167693 A 6/2001

* cited by examiner

*Primary Examiner* — Toan Ton
*Assistant Examiner* — Britt D Hanley
(74) *Attorney, Agent, or Firm* — Canon USA, Inc., I.P. Division

(57) ABSTRACT

An electron emission device in an electron beam apparatus includes an insulating member having a recess on a surface thereof, a gate, and a cathode opposed to the gate via the recess. The recess has a depression formed in a surface of the recess.

4 Claims, 7 Drawing Sheets

ELECTRON BEAM APPARATUS HAVING A RECESS FORMED IN A SURFACE OF AN INSULATING MEMBER

BACKGROUND OF THE INVENTION

1. Field of the Invention

The present invention relates to an electron beam apparatus including an electron emission device configured to emit electrons for use in a flat panel display, and an image display apparatus constructed using such an electron beam apparatus.

2. Description of the Related Art

An electron emission device is known that operates in such a manner that electrons are emitted from a cathode so that most of the emitted electrons collide with a gate opposed to the cathode and the electrons are scattered and emitted. Specific examples of this type of electron emission device include a surface-conduction electron emission device and a multilayer electron emission device. In a multilayer electron emission device disclosed in Japanese Patent Laid-Open No. 2001-167693, a recess is formed in an insulating layer at a location close to an electron emission part.

SUMMARY OF THE INVENTION

The present invention provides an electron emission device having an improved electron emission efficiency, an electron beam apparatus using such an electron emission device, and a high-performance image display apparatus using such an electron beam apparatus.

According to an embodiment of the present invention, there is provided an electron beam apparatus including an insulating member having a recess formed in a surface thereof, a gate disposed on the surface of the insulating member, a cathode disposed on the surface of the insulating member, the cathode being located such that the cathode faces the gate via the recess, and an anode opposed to the cathode via the gate, wherein the recess has a step structure formed on a surface close to an edge where the cathode is located.

According to an embodiment of the present invention, there is provided an image display apparatus including the electron beam apparatus described above and a light emission part disposed on the anode.

In the embodiment of the invention, a short-circuit path between electrodes of the electron emission device is cut into two pieces thereby reducing a leakage current between the electrodes whereby an improved electron emission efficiency can be achieved. Thus, the image display apparatus has improved image quality.

Further features of the present invention will become apparent from the following description of exemplary embodiments with reference to the attached drawings.

DESCRIPTION OF THE EMBODIMENTS

An electron beam apparatus according to an embodiment of the present invention includes an electron emission device configured to emit electrons, and an anode configured to receive the electrons emitted from the electron emission device.

The electron emission device includes an insulating member, a gate, and a cathode. A recess is formed in the surface of the insulating member, and the gate and the cathode are disposed on the surface of the insulating member such that they face each other via the recess. The anode is disposed such that it faces the cathode via the gate.

An image display apparatus according to an embodiment of the present invention includes the electron beam apparatus described above, and a phosphor is disposed as a light emission part on the anode.

In the electron emission device according to an embodiment of the invention, the recess has a step structure on a surface close to an edge where the cathode is located. The step structure may be a depression depressed from the surface of the recess or a protrusion protruded from the surface of the recess.

Figure 1A:
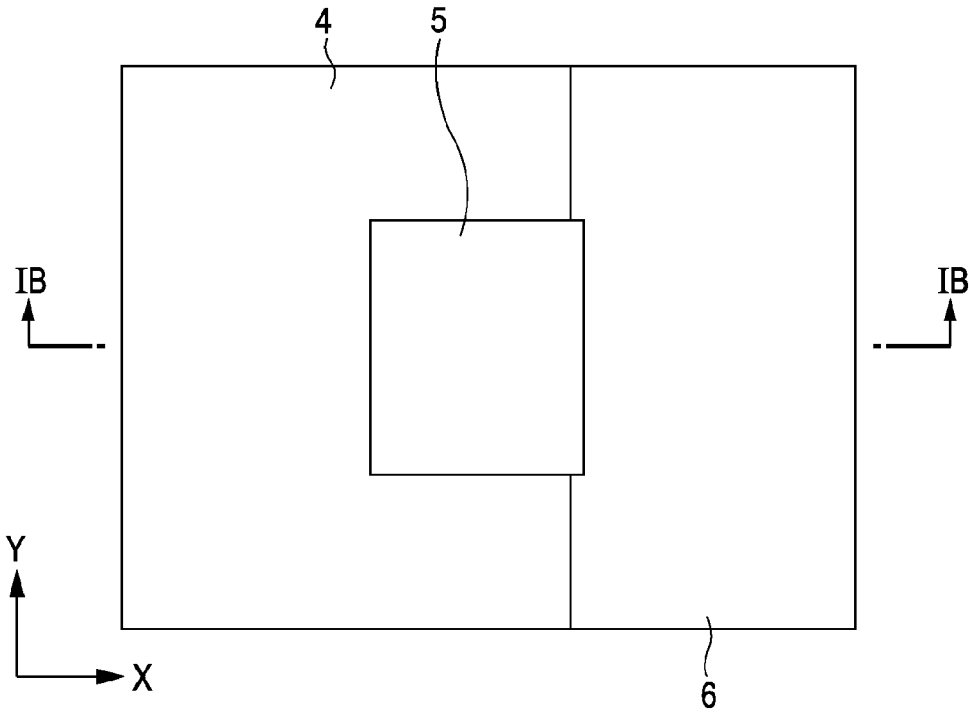
FIGS. 1A and 1B are schematic diagrams illustrating a structure of an electron emission device in an electron beam apparatus according to an embodiment of the present invention.
Figure 1B:
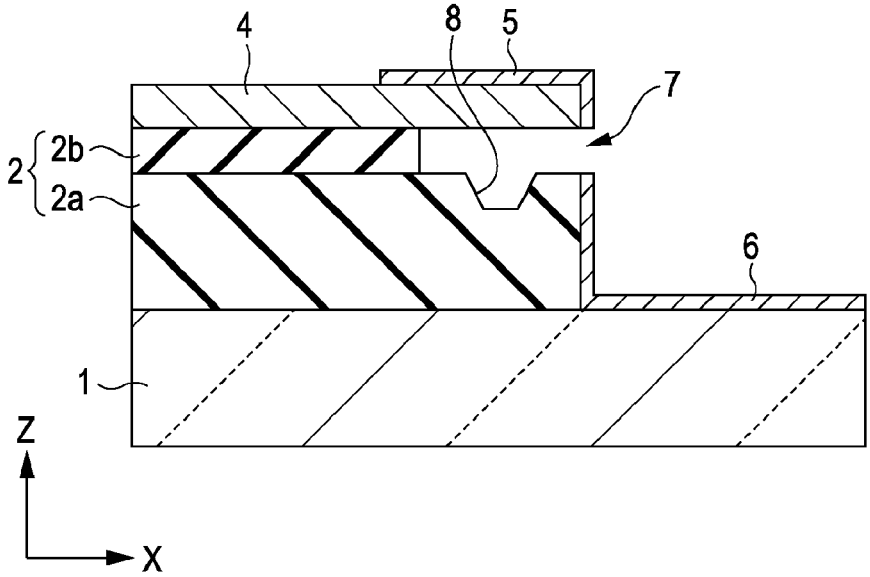

FIGS. 1A and 1B are schematic diagrams illustrating an example of an electron emission device in an electron beam apparatus according to an embodiment of the present invention. In this example, a depression is formed as the step structure. Note that FIG. 1A is a plan view and FIG. 1B is a cross-sectional view taken along line IB-IB of FIG. 1A.

In FIGS. 1A and 1B, reference numeral 1 denotes a substrate, reference numeral 2 denotes an insulating member including a first insulating layer 2*a* and a second insulating layer 2*b*, and reference numeral 4 denotes a gate. Reference numeral 5 denotes a raised part disposed on the gate. Reference numeral 6 denotes a cathode, reference numeral 7 denotes a recess formed in the insulating member 2, and reference numeral 8 denotes a depression formed in the recess 7.

Figure 2:
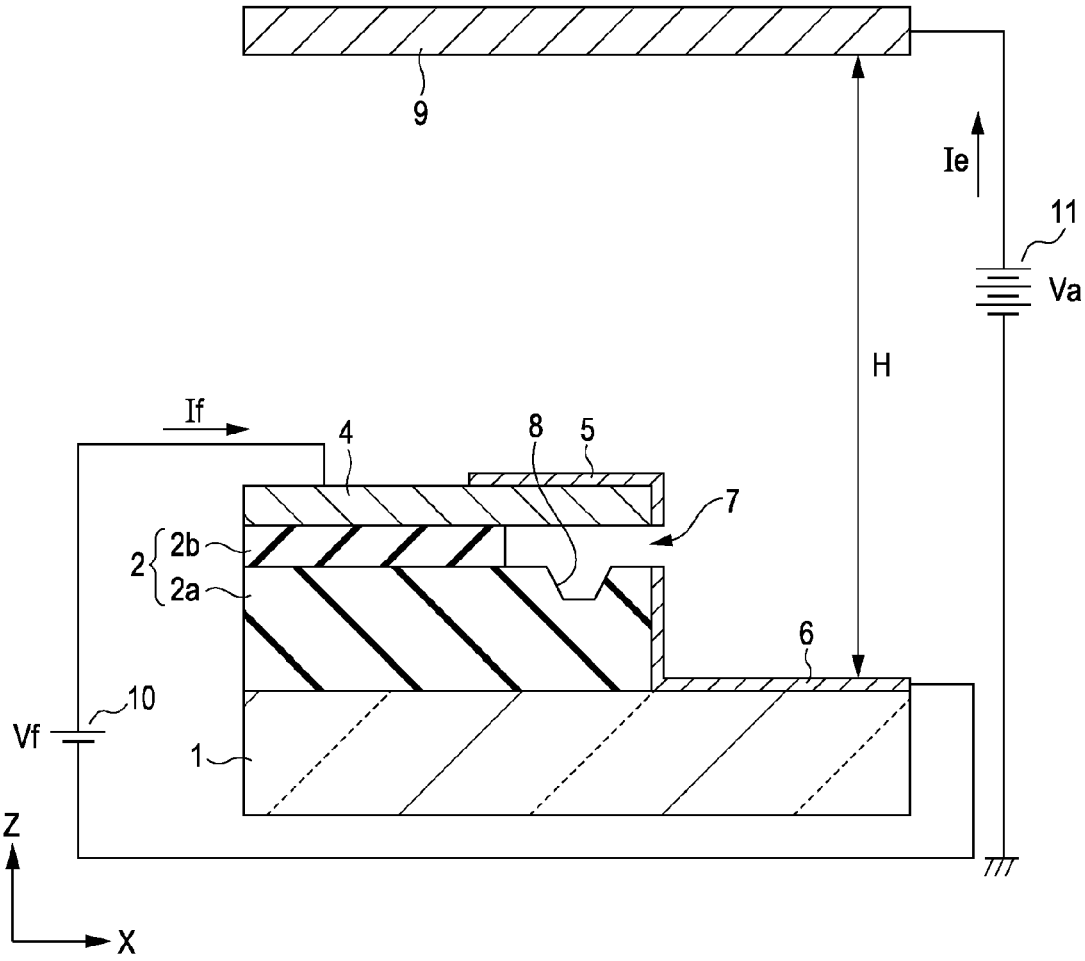
FIG. 2 is a schematic diagram illustrating a structure of an electron emission device in a state in which the electron emission device is being driven.

FIG. 2 is a schematic diagram illustrating an electron beam apparatus having the electron emission device shown in FIG. 1 being in a driven state. In FIG. 2, reference numeral 9 denotes an anode, reference numeral 10 denotes a driving power supply that drives the electron emission device, and reference numeral 11 denotes a high voltage source for supplying a high voltage to the anode.

In the electron emission device according to the present embodiment of the invention, the power supply 10 supplies a driving voltage Vf between the gate 4 and the cathode 6 whereby a device current If flows. Note that the driving voltage Vf is applied such that the gate 4 and the raised part 5 are higher in potential with respect to the cathode 6. An anode voltage Va is applied by the high voltage source 11 to the anode 9 so that electrons emitted from the cathode 6 is captured by the anode 9 and an emission current Ie flows. The voltage applied between the gate 4 and the cathode 6 may be in a range from 10 V to 100 V. Preferably, the voltage applied between the gate 4 and the cathode 6 may be in a range from 10 V to 30 V.

In the present embodiment of the invention, the cathode 6 and the raised part 5 that are parts of the electron emission device are obtained by forming a film of a conductive material on the surface of the insulating member 2 by vacuum evaporation or the like. However, there is a possibility that the conductive material is deposited inside the recess 7 during the film forming process, which can cause a short-circuit path to be formed between the cathode 6 and the gate 4 and/or the raised part 5. If such a short-circuit path is formed, a leakage current can flow between the cathode 6 and the gate 4 when the electron emission device is driven, which can cause a reduction in electron emission efficiency.

In the present embodiment of the invention, a step structure is formed in the recess 7 thereby forming a non-film area where no conductive material is deposited and thus cutting the short-circuit path, which results in a reduction in leakage current.

More specifically, a depression 8 or a protrusion is formed in the recess 7, on the surface close to an edge where the cathode 6 is located.

Figure 3A:
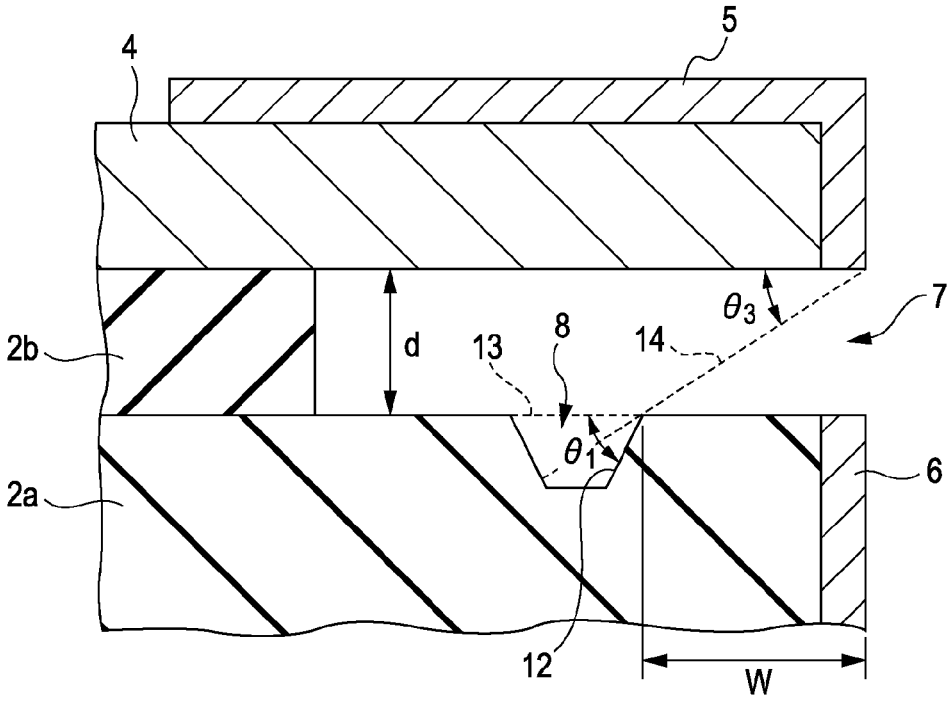
FIG. 3 is an enlarged cross-sectional view of a recess in an electron emission device according to an embodiment of the present invention.
Figure 3B:
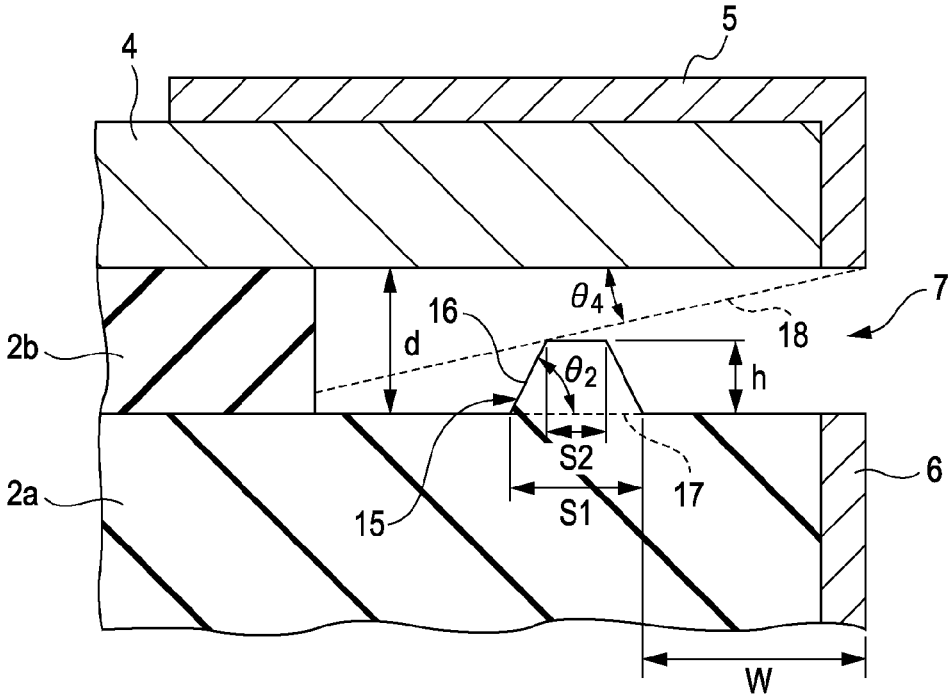

FIGS. 3A and 3B are enlarged cross-sectional views of the recess 7. FIG. 3A illustrates an example in which a depression 8 is formed as with the structure shown in FIGS. 1A and 1B, and FIG. 3B illustrates an example in which a protrusion 15 is form as the step structure.

In FIG. 3A, the film of the conductive material formed on the surface of the recess 7 via the film formation process can be cut into two pieces by the depression 8, if the film formation process is performed under a proper condition as described below.

That is, when the angle between a side wall 12 of the depression 8 located closer to an opening of the recess 7 and an imaginary plane 13 extending over the depression 8 from the surface of the recess 7 is denoted by $\theta_1$, and the angle between an imaginary line 14 extending from the upper edge of the recess 7 (i.e., the lower edge of the gate 4) and an upper edge of the side wall 12 of the depression 8 and the upper surface of the recess 7 (i.e., the lower surface of the gate 4) is denoted by $\theta_3$, the angle $\theta_1$ should be greater than the angle $\theta_3$ (i.e., $\theta_1>\theta_3$).

If the distance from an edge of the recess 7 on the side where the cathode 6 is located to the gate 4 is denoted by d and the distance from this edge of the recess 7 to the depression 8 is denoted by W, then the above condition can be equivalently described as follows:

$$\theta_1>\tan^{-1}(d/W)$$

If the above condition is satisfied, then as shown in FIG. 3A, a non-film area in which no conductive material is deposited is obtained over a sufficiently large area of the surface of the recess 7. In the example shown in FIG. 3A, the non-film area includes the side wall 12 of the depression 8, the bottom surface of the depression 8, and a lower part of a side wall opposite to the side wall 12.

In the case where the protrusion 15 is formed as the step structure, the film of the conductive material formed on the surface of the recess 7 in the film formation process can be cut into two pieces by the protrusion 15, if the film formation process is performed under a proper condition as described below.

That is, when the angle between a back-side side wall 16 of the protrusion 15 in the recess 7 and a bottom 17 of the protrusion 15 is denoted by $\theta_2$, and the angle between an imaginary line 18 extending from the upper edge of the recess 7 (i.e., the lower edge of the gate 4) and a back-side upper edge of the protrusion 15 (i.e., the upper edge of the side wall 16) and the upper surface of the recess 7 (i.e., the lower surface of the gate 4) is denoted by $\theta_4$, the angle $\theta_2$ should be greater than the angle $\theta_4$ (i.e., $\theta_2>\theta_4$).

If the width of the upper surface of the protrusion 15 is denoted by $S_1$ and the width of the bottom of the protrusion 15 is denoted by $S_2$, then the above-described condition can be equivalently expressed as follows.

$$\theta_2>\tan^{-1}\{(d-h)/(W+S_2+(S_1-S_2)/2)\}$$

If the above condition is satisfied, then as shown in FIG. 3B, a non-film area in which no film of conductive material is formed is obtained over a sufficiently large area of the surface of the recess 7. In the example shown in FIG. 3B, the non-film area includes the side wall 16 of the protrusion 15, a surface area of the recess 7 behind the protrusion 15, and a lower part of the side wall of the second insulating layer 2*b*.

The electron emission device according to the present embodiment of the invention is described in further detail below for each part thereof.

As for the substrate 1, for example, a quartz glass substrate, a substrate made of glass containing reduced impurities such as Na, a soda-lime glass substrate, a soda-lime glass or a Si substrate on which a $SiO_2$ layer is formed by sputtering or the like, a substrate made of an insulating material such as alumina or other ceramics, etc. may be used.

Materials usable for the gate 4 include metals such as Be, Mg, Ti, Zr, Hf, V, Nb, Ta, Mo, W, Al, Cu, Ni, Cr, Au, Pt, or Pd, alloys of such metals, carbides such as TiC, ZrC, HfC, TaC, SiC, or WC, borides such as $HfB_2$, $ZrB_2$, $CeB_6$, $YB_4$, or $GbB_4$, nitrides such as TaN, TiN, ZrN, or HfN, semiconductors such as Si or Ge, organic polymers, amorphous carbon, graphite, diamond-like carbon, and carbon or carbon compounds mixed with scattered diamond.

The raised part 5 and the cathode 6 may be made of, for example, a metal such as Mo, Pt, Ru, Ag, Au, Ti, In, Cu, Cr, Fe, Zn, Sn, Ta, W, or Pd or other materials having a low work function such as carbon or HfC.

The first insulating layer 2*a* and the second insulating layer 2*b* may be made of a material having a high breakdown voltage. More specifically, for example, an oxide such as $SiO_2$ or a nitride such as $Si_3N_4$ may be used. Note that the materials for the first insulating layer 2*a* and the second insulating layer 2*b* are properly selected such that the second insulating layer 2*b* can be selectively etched by a properly selected etchant substantially without etching the first insulating layer 2*a*. For example, the first insulating layer 2*a* may be made of an insulating material such as $Si_3N_4$ while the second insulating layer 2*b* may be made of an insulating material such as $SiO_2$.

The thickness of the first insulating layer 2*a* may be set within a range from 50 nm to 3 μm. Preferably, the thickness of the first insulating layer 2*a* may be set within a range from 100 nm to 500 nm. The thickness of the second insulating layer 2*b* may be set within a range from 1 nm to 100 μm. Preferably, the thickness of the second insulating layer 2*b* may be set within a range from 1 nm to 40 nm. The thickness of the gate 4 may be set within a range from 1 nm to 100 nm.

The recess 7 is formed such that the recess 7 has an opening located between the gate 4 and the edge of the first insulating layer 2*a*. The width of the opening is substantially given by the space between the gate 4 and the first insulating layer 2*a*, i.e., the width of the opening is substantially equal to the thickness of the second insulating layer 2*b*. The depth of the recess 7 may be set within a range from 1 nm to 400 nm. Preferably, the depth of the recess 7 may be set within a range from 30 nm to 100 nm.

Next, referring to FIGS. 4A to 4H, an example of a process of producing the electron emission device according to the present embodiment is described below.

Figure 4A:
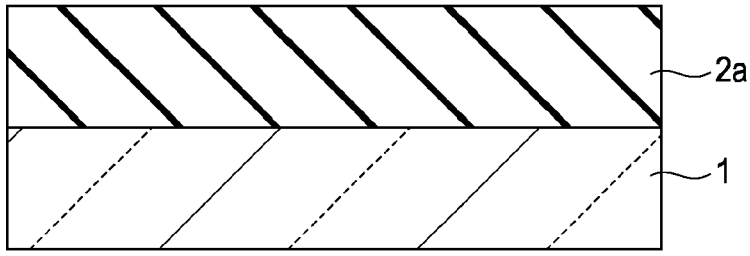
FIGS. 4A to 4H are schematic diagrams illustrating a process of producing an electron emission device according to an embodiment of the present invention.

A substrate 1 whose surface has been cleaned is prepared, and a first insulating layer 2*a* is formed thereon by a vacuum film formation technique such as sputtering, CVD (Chemical Vapor Deposition), or vacuum evaporation (FIG. 4A).

Figure 4B:
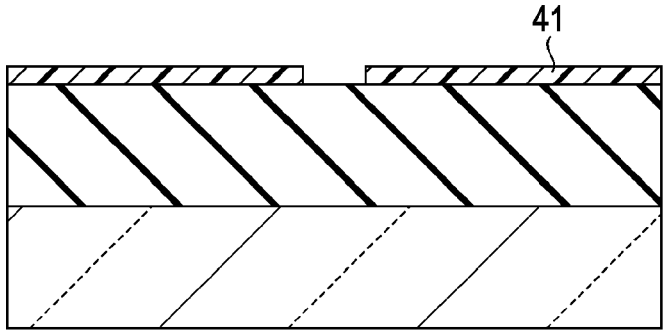

Next, a photolithography process is performed to form a resist pattern 41 having an opening (FIG. 4B).

Figure 4C:
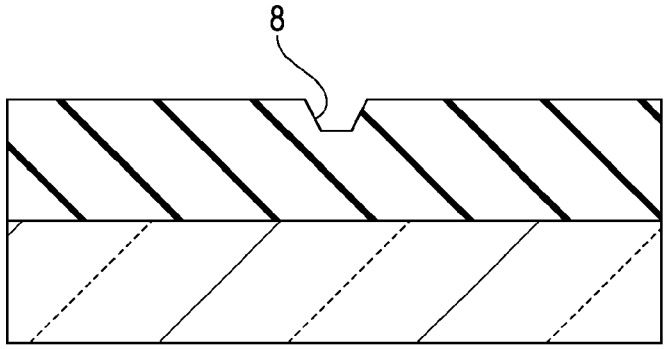

Etching is then performed to form a depression 8 serving as a step structure on the surface of the first insulating layer 2*a* at a location corresponding to the opening of the resist pattern 41. In this process, a proper etching method may be selected depending on the material of the first insulating layer 2*a*. The depth of the depression 8 may be set in a range from a few nm to a depth equal to the thickness of the first insulating layer 2*a*. Preferably, the depth of the depression 8 may be set within a range from a few nm to few ten nm (FIG. 4C). The angle of the side walls of the depression 8 may be controlled by properly selecting etching parameters such as an etching rate, an etching time, etc.

Figure 4D:
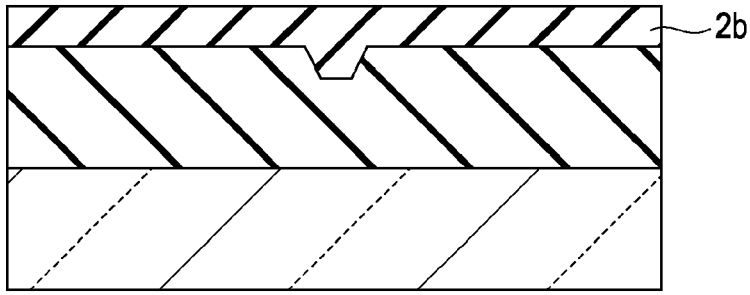

Subsequently, a second insulating layer 2*b* is formed on the first insulating layer 2*a* by a vacuum film formation technique such as sputtering, CVD (Chemical Vapor Deposition), or vacuum evaporation (FIG. 4D).

Figure 4E:
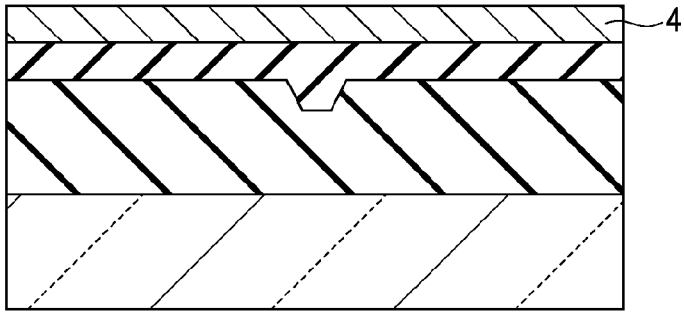

A conductive film for forming a gate 4 is then deposited on the second insulating layer 2*b* by a vacuum film formation technique such as sputtering, CVD (Chemical Vapor Deposition), or vacuum evaporation (FIG. 4E).

Figure 4F:
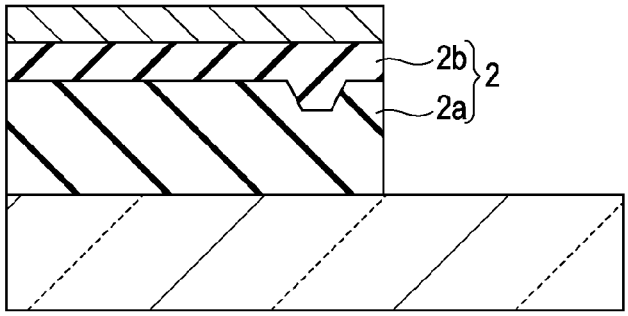

Subsequently, a photolithography process is performed to partially remove the first insulating layer 2*a*, the second insulating layer 2*b*, and the gate film 4, which have been formed in the previous steps. The etching may be stopped at the surface of the substrate 1, or the substrate 1 may be partially etched (FIG. 4F). More specifically, the process performed in this step includes spin-coating a photoresist, exposing the photoresist to a mask pattern, developing the photoresist, and performing wet etching or dry etching to partially remove the first insulating layer 2*a*, the second insulating layer 2*b*, and the gate 4.

In the etching process, it is desirable to obtain a smooth and vertical etched surface. A proper etching method may be selected depending on the materials of the electrode and the insulating layers.

Figure 4G:
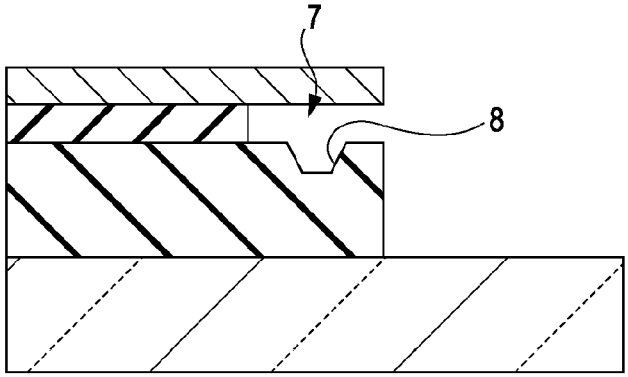

Thereafter, a recess 7 is formed in the insulating member 2 by wet etching. In a case where TaN, $Si_2N_4$, and $SiO_2$ are selected as the materials of the gate 4, the first insulating layer 2*a*, and the second insulating layer 2*b*, respectively, the etching may be performed using buffered hydrofluoric acid as the etchant. That is, the second insulating layer 2*b* is selectively etched such that only the second insulating layer 2*b* is recessed from the side wall of the insulating member 2 thereby forming the recess 7 having an opening (FIG. 4G). Note that as a result of this step, the depression 8 is exposed to the surface of the first insulating layer 2*a* functioning as the surface of the recess 7.

Figure 4H:
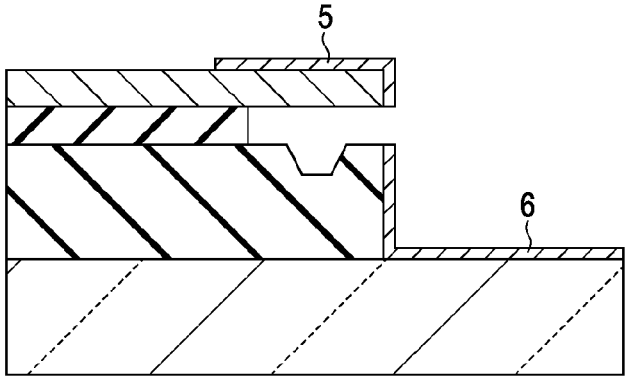

After the recess 7 is formed in the insulating member 2, a film for forming a raised part 5 and a cathode 6 is deposited. Note that the raised part 5 and the cathode 6 are formed using a conductive material by a film forming process such as photolithography, oblique evaporation, sputtering, etc. (FIG. 4H).

Next, referring to FIGS. 5 and 6, an electron source including a plurality of electron emission devices arranged in the form of an array and an image display apparatus using this electron source according to an embodiment of the present invention are described below.

Figure 5:
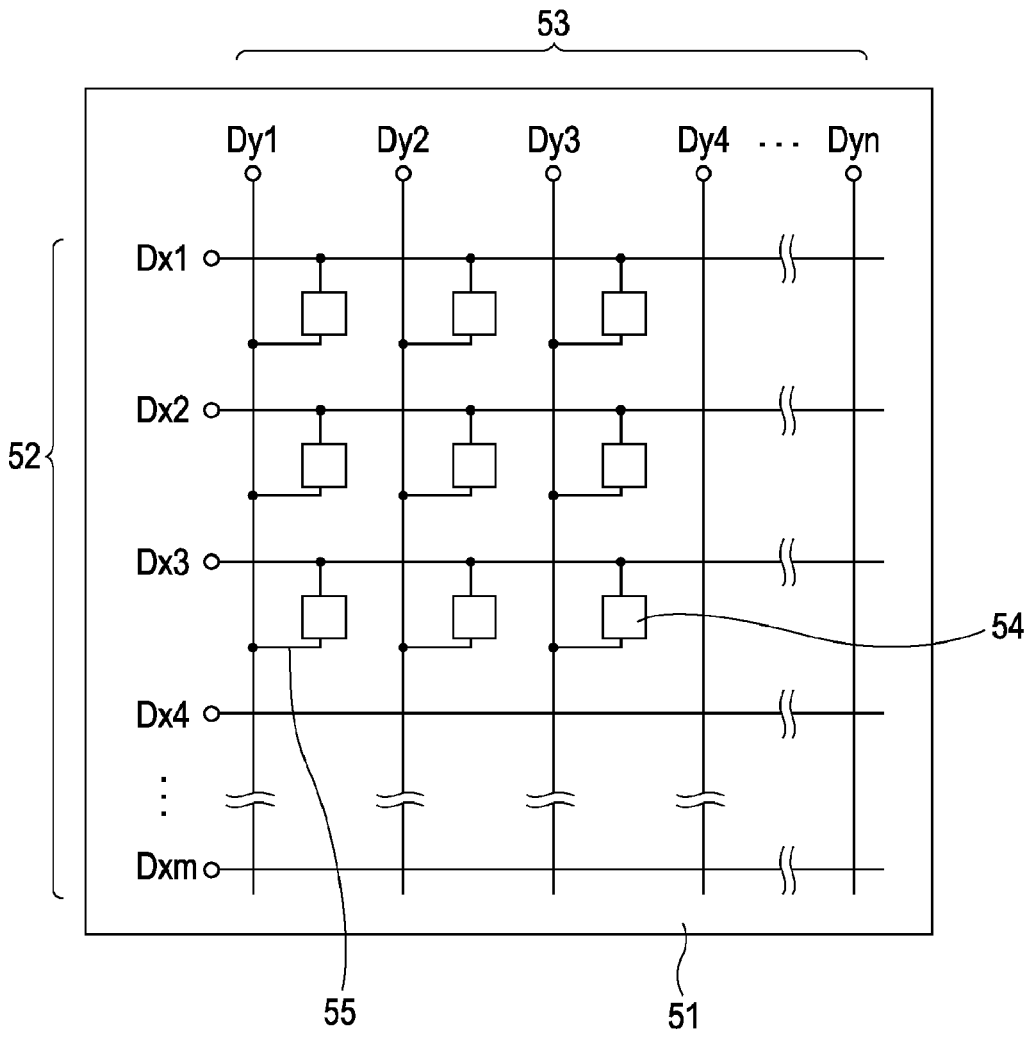
FIG. 5 is a schematic diagram illustrating an electron source including a plurality of electron emission devices according to an embodiment of the present invention.

In FIG. 5, reference numeral 51 denotes an electron source substrate, reference numeral 52 denotes X-direction interconnections, reference numeral 53 denotes Y-direction interconnections, reference numeral 54 denotes electron emission devices according to the present embodiment, and reference numeral 55 denotes interconnections. Note that the X-direction interconnections 52 are interconnections that connect together the cathodes 6 of the electron emission devices, and the Y-direction interconnections 53 are interconnections that connect together the gates 4.

There are m X-direction interconnections 52 denoted by Dx1, Dx2, . . . , Dxm. They are formed using a conductive metal by vacuum evaporation, printing, sputtering, or other methods. The material, the thickness, and the width of the X-direction interconnections 52 may be properly selected.

There are n Y-direction interconnections 53 denoted by Dy1, Dy2, . . . , Dyn. They are formed in a similar manner to the X-direction interconnections 52. An interlayer insulating film (not shown) is formed between the m X-direction interconnections 52 and the n Y-direction interconnections 53 so that they are electrically isolated. Note that m and n are positive integers.

The interlayer insulating film (not shown) is formed using $SiO_2$ or the like by vacuum evaporation, printing, sputtering, or other methods. The interlayer insulating film is formed such that after the X-direction interconnections 52 are formed on the electron source substrate 51, the interlayer insulating film is formed over the entire or partial area of the electron source substrate 51. Note that the material, the thickness, and the width of the interlayer insulating film may be properly selected such that it has a breakdown voltage greater than a voltage appearing between the X-direction interconnections 52 and the Y-direction interconnections 53 at each intersection thereof. The X-direction interconnections 52 and the Y-direction interconnections 53 are respectively connected to terminals for external connections.

In the present embodiment of the invention, the gate and the cathode (not shown) of each electron emission device 54 are connected to corresponding m X-direction interconnections 52 and n Y-direction interconnections 53 via corresponding interconnections 55.

The materials may or may not be the same in terms of all or part of constituent elements for the X-direction interconnections 52 and the Y-direction interconnections 53, the interconnections 55, and the gates and cathodes.

The X-direction interconnections 52 are connected to a scanning signal applying unit (not shown) configured to apply a scanning signal to select a particular row (in the X direction) of electron emission devices 54. The Y-direction interconnections 53 are connected to a modulation signal generator (not shown) configured to generate a signal to modulate each column (in the Y direction) of electron emission devices 54 according to an input signal.

A driving voltage applied to each electron emission device is given by the difference between the scanning signal and the modulation signal applied to the electron emission device.

In the configuration described above, each individual electron emission device can be selected and driven independently using the simple matrix interconnections.

Next, referring to FIG. 6, an image display apparatus constructed using the simple matrix electron source is described below. FIG. 6 schematically illustrates, in a partially cut away fashion, an example of an image display apparatus.

Figure 6:
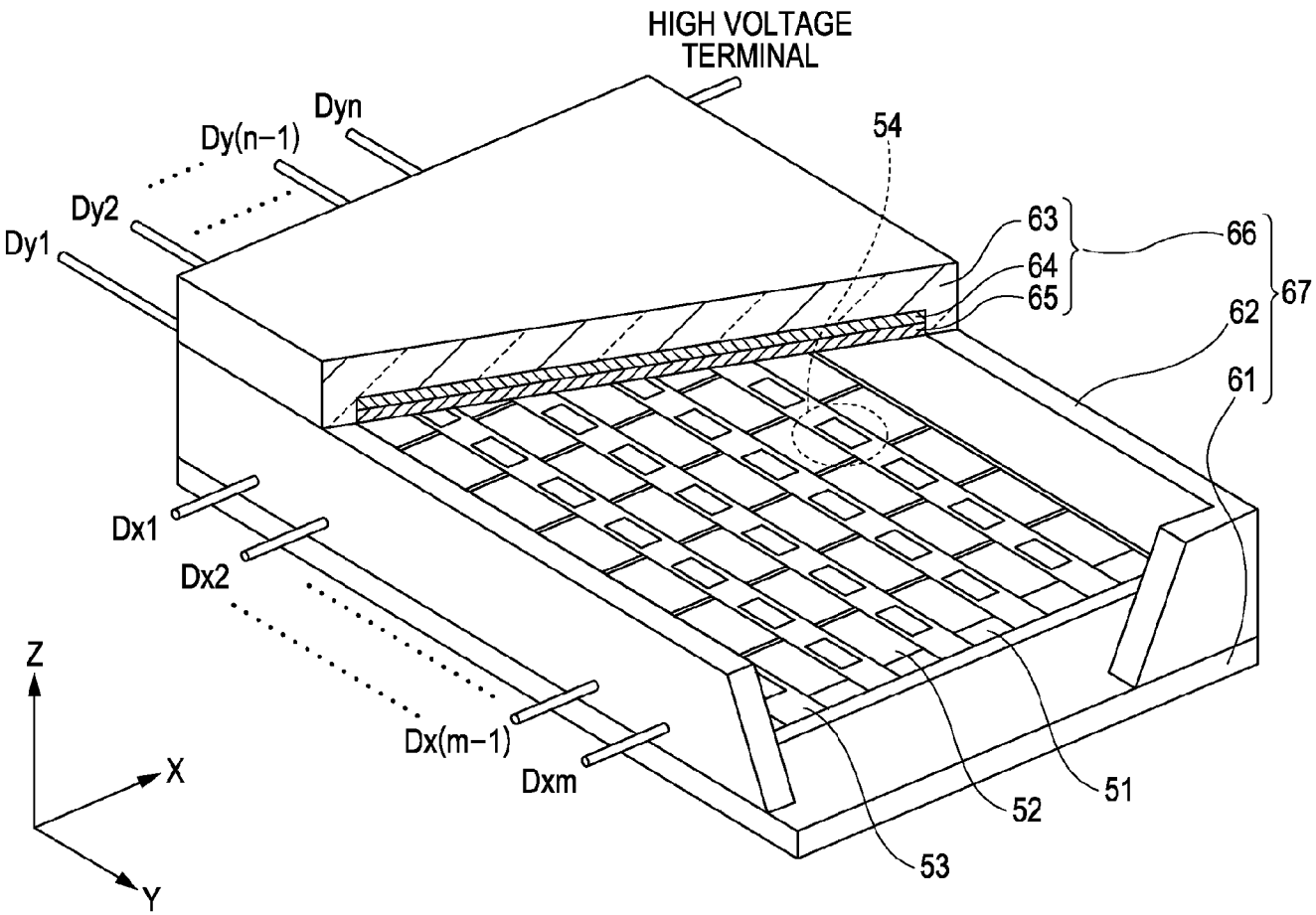
FIG. 6 is a schematic diagram illustrating an structure of an image display apparatus according to an embodiment of the present invention.

In FIG. 6, reference numeral 51 denotes an electron source substrate on which a plurality of electron emission devices are disposed, reference numeral 61 denotes a rear plate fixed to the electron source substrate 51, and reference numeral 66 denotes a face plate including a glass substrate 63, a phosphor film 64 having a phosphor serving as a light emission part disposed on the inner surface of the glass substrate 63, and a back-side metal 65.

Reference numeral 62 denotes a supporting frame. To this supporting frame 62, the rear plate 61 and the face plate 66 are connected via fritted glass. Reference numeral 67 denotes an enclosure that is constructed in a sealed form by burning in the air or nitrogen ambient at a temperature in a range from 400 to 500° C. for 10 min or longer.

Reference numeral 54 denotes an electron emission device similar to that shown in FIG. 1. Reference numerals 52 and 53 denote an X-direction interconnection and a Y-direction interconnection respectively connected to a cathode and a gate of the electron emission device.

As described above, the enclosure 67 is composed of the face plate 66, the supporting frame 62, and the rear plate 61. The primary purpose of the rear plate 61 is to reinforce the mechanical strength of the substrate 51. If the substrate 51 has sufficiently large mechanical strength, the rear plate 61 may be removed.

That is, the substrate 51 may be directly connected to the supporting frame 62 on which the face plate 66 is disposed. In this case, the enclosure 67 is composed of the face plate 66, the supporting frame 62, and the substrate 51. A supporting member called spacer (not shown) may be disposed between the face plate 66 and the rear plate 61 thereby enhancing the strength of the enclosure 67 against the atmospheric pressure.

In the image display apparatus using the electron emission devices according to the present embodiment of the invention, the phosphor disposed above the electron emission devices is aligned taking into account the travelling path of the emitted electrons.

The electron source is connected to an external electric circuit via terminals Dx1 to Dxm, terminals Dy1 to Dyn, and a high-voltage terminal Hv disposed on the enclosure 67.

Scanning signals are applied to the terminals Dx1 to Dxm to drive the electron source disposed in a display panel, i.e., the electron emission devices disposed in the form of an m×n matrix sequentially on a row-by-row basis (N devices in one row at a time).

On the other hand, modulating signals are applied to the terminals Dy1 to Dyn to control the output electron beams emitted from the electron emission devices in a row selected by the scanning signal.

A DC voltage of, for example, 10 kV is supplied to the high-voltage terminal Hv from a DC voltage source Va thereby accelerating the electrons emitted from the electron emission device to have sufficiently high energy to excite the phosphor.

Displaying an image is achieved by applying the scanning signal and the modulating signal properly in the above-described manner and by applying the high voltage to the anode so that accelerated electrons properly hit the phosphor.

Note that the present invention is not limited to the details of the embodiments described above, but constituent elements may be replaced with alternative or equivalent elements.

EXAMPLES

The present invention is described in further detail below with reference to specific examples.

Example 1

In Example 1, the electron emission device shown in FIGS. 1A and 1B and 3A was produced via the process shown in FIG. 4A to 4H.

Step 1. A soda-lime glass substrate for the substrate 1 was prepared. After the substrate 1 was well cleaned, a $Si_3N_4$ film with a thickness of 500 nm was deposited on the substrate 1 by sputtering thereby forming the first insulating layer 2*a* (FIG. 4A).

Step 2. Thereafter, a photolithography process was performed. More specifically, a positive photoresist (TSMR-8900 (available from Tokyo Ohka Kogyo Co., Ltd.)) was spin-coated, and then exposed to light via a photomask pattern. Subsequently, development was performed thereby forming the resist pattern 41 having an opening (FIG. 4B).

Using this photoresist 41 as an etching mask, the first insulating layer 2*a* was wet-etched by an etchant of phosphoric acid ($H_2PO_4$) heated at 180° C. As a result, the depression 8 with a depth of 10 nm was formed in the surface of the first insulating layer 2*a* (FIG. 4C).

Step 3. Next, a $SiO_2$ layer with a thickness of 20 nm and then a TaN layer with a thickness of 20 nm were deposited by sputtering thereby forming the second insulating layer 2*b* and the gate 4 (FIG. 4E).

Step 4. Thereafter, a photolithography process was performed. More specifically, a positive photoresist (TSMR-9800 (available from Tokyo Ohka Kogyo Co., Ltd.)) was spin-coated, and then exposed to light via a photomask pattern. Subsequently, development was performed thereby forming a resist pattern.

Using this photoresist as an etching mask, the first insulating layer 2*a*, the second insulating layer 2*b*, and the gate 4 were dry-etched using $CF_4$ gas such that the etching was stopped at the surface of the substrate 1 (FIG. 4F).

Step 5. Subsequently, etching using buffered hydrofluoric acid (LAL100 (available from Stella Chemifa Corporation) was performed for 11 min to selectively etching the second insulating layer 2*a*. As a result, the side wall of the second insulating layer 2*b* was recessed by about 60 nm and the recess 7 was formed (FIG. 4G).

Step 6. Next a Mo film with a thickness of 10 nm was selectively deposited by oblique evaporation at an angle of 45° thereby forming the raised part 5 and cathode 6 (FIG. 4H).

The cross-sectional shape of the electron emission device produced in the above-described manner was observed using an electron microscope (TEM). The observation showed that the distance d from the edge, on which the cathode 6 was located, of the recess 7 to the gate 4 was 20 nm, and the distance W from the edge of the recess 7 to the depression 8 was 40 nm. The angle $\theta_1$ of the side wall 12 of the depression 8 with respect to the imaginary plane extending over the depression 8 from the surface of the recess 7 was 45°.

Thus, $\theta_3=\tan^{-1}(d/W)$ was calculated as 27°, which was smaller than $\theta_1$. There was no Mo film deposited on the side wall 12 of the depression 8.

A voltage of 10 V was applied between the gate 4 and the cathode 6 of the electron emission device, and a leakage current was measured. The result showed that the leakage current was 0.03 μA, which was smaller than that observed for a conventional electron emission device being driven.

Example 2

The electron emission device having the protrusion 15 shown in FIG. 3B was produced via a process described below.

Step 1. This step was performed in a similar manner to the Example 1 described above.

Step 2. Thereafter, a photolithography process was performed. More specifically, a positive photoresist (TSMR-8900 (available from Tokyo Ohka Kogyo Co., Ltd.)) was spin-coated, and then exposed to light via a photomask pattern. Subsequently, development was performed thereby forming a resist pattern.

Using this photoresist as an etching mask, the first insulating layer 2*a* was wet-etched by an etchant of phosphoric acid ($H_3PO_4$) heated at 180° C. As a result, the protrusion 15 with S1=30 nm, S2=10 nm, and h=10 nm was formed on the surface of the first insulating layer 2*a*.

Steps 3 to 6. These steps were performed in a similar manner to Example 1 described above.

The cross-sectional shape of the electron emission device produced in the above-described manner was observed using an electron microscope (TEM). The observation showed that the distance d from the edge, on which the cathode 6 was located, of the recess 7 to the gate 4 was 20 nm, and the distance W from the edge of the recess 7 to the protrusion 15 was 40 nm. The angle $\theta_2$ of the back-side side wall 16 of the protrusion 15 in the recess 7 with respect to the bottom 17 of the protrusion 15 was 45°.

Thus, $\theta_4=\tan^{-1}\{(d-h)/(W+S_2+(S_1-S_2)/2)\}$ was calculated as 9.5°, which was smaller than $\theta_2$. There was no Mo film deposited on the side wall 16 of the protrusion 15.

A voltage of 10 V was applied between the gate 4 and the cathode 6 of the electron emission device produced, and a leakage current was measured. The result showed that the leakage current was 0.03 μA, which was smaller than that observed for a conventional electron emission device being driven.

Comparative Example

As a comparative example, an electron emission device was produced in a similar manner to Example 1 except that the depression 8 was not formed.

A voltage of 10 V was applied between the gate 4 and the cathode 6 of the electron emission device produced, and a leakage current was measured. The result showed that the leakage current was greater than 30 μA.

Example 3

An electron source including a plurality of electron emission devices formed on a substrate 1 via a process similar to that used in Example 1 was produced, and electric characteristics thereof were evaluated.

One of the X-direction interconnections 52 (i.e., Dx1) was selected, and a pulse voltage of −6 V with a width of 1 msec was applied thereto at intervals of 16.6 msec. In synchronization with this pulse voltage, a pulse voltage of +13.5 V with a width of 1 msec was applied sequentially to the Y-direction interconnections 53 (Dy1 to Dym) at intervals of 16.6 msec for 30 sec. Subsequently, application of pulse voltages was performed sequentially to other X-direction interconnections 52 (Dx2 to Dxn) such that the pulse voltage of 19.5 V was applied to all electron emission devices 54 During this process, any non-selected interconnection was connected to a ground level.

Subsequently, in a similar manner, one of the X-direction interconnections 52 (i.e., Dx1) was selected, and a pulse voltage of −6 V with a width of 0.1 msec was applied thereto at intervals of 16.6 msec. In synchronization with this pulse voltage, a pulse voltage of +10 V with a width of 0.1 msec was applied sequentially to the Y-direction interconnections 53 (Dy1 to Dym) at intervals of 16.6 msec. Subsequently, application of pulse voltages was performed sequentially to other X-direction interconnections 52 (Dx2 to Dxn) such that the pulse voltage of 16 V was applied to all electron emission devices 54 thereby driving the electron emission devices 54. During the driving of the electron emission devices 54, a device current flowing through each electron emission device 54 was measured.

Thereafter, all Y-direction interconnections 53 are connected to the ground level. Thereafter, one of the X-direction interconnections 52 (i.e., Dx1) was selected, and a pulse voltage of −6 V with a width of 0.1 msec was applied thereto at intervals of 16.6 msec and a device current (leakage current) flowing through the electron emission device 54 connected to the selected X-direction interconnection 52 (Dx1) was measured. The voltage application is performed sequentially for other X-direction interconnections 52 (Dx2 to Dxn) and leakage current flowing through each X-direction interconnection 52 was measured.

Subsequently, a pulse voltage of −6 V with a width of 0.1 msec was applied at intervals of 16.6 msec sequentially to the X-direction interconnections 52. In synchronization with this, a pulse voltage of +10 V with a width of 0.1 msec was applied sequentially to the Y-direction interconnections 53 at intervals of 16.6 msec thereby driving the all electron emission devices 54 continuously for a particular period. Thereafter, leakage current flowing through each X-direction interconnection 52 was measured in a similar manner.

The measured leakage current per one electron emission device was 0.03 μA (on average), which was similar to the result of Example 1.

Example 4

An image display apparatus such as that shown in FIG. 6 was produced using the electron source produced in Example 3.

A face plate 66 was connected to the electron source substrate 51 via a supporting frame 62 in a vacuum such that the face plate 66 was located 2 mm above the electron source substrate 51 thereby forming a sealed enclosure 67. A spacer (not shown) was disposed between the face plate 66 and the electron source substrate 51 so that the enclosure 67 had a structure capable of withstanding the atmospheric pressure. A getter (not shown) was disposed in the enclosure 67 so that the getter allows the inside of the enclosure 67 to be maintained in high vacuum. Indium was used for bonding between the electron source substrate 51 and the supporting frame 62 and the bonding between the supporting frame 62 and the face plate 66.

After the image display apparatus was obtained in the above-described manner, pulse voltages were applied in a similar manner as in Example 3 and device currents and leakage currents were measured in a similar manner as in Example 3. The measured leakage current per one electron emission device was 0.03 μA (on average), which was similar to the result of Example 3.

Next, a scanning signal was applied to the X-direction interconnections 52 and an information signal was applied to the Y-direction interconnections 53 thereby driving the electron emission devices 54. In this driving, a pulse voltage of +6 V was used as the information signal, and a pulse voltage of −10 V was used as the scanning signal. A voltage of 6 KV was applied to the back-side metal 65 via the high voltage terminal Hv thereby colliding the emitted electrons into the phosphor film 64 and thus exciting the phosphor film 64 so that light was emitted from the phosphor film 64. As a result, an image with high brightness was displayed.

Leakage currents of each electron emission device 54 were measured in a similar manner as in Example 3. The measured leakage current per one electron emission device was 0.03 μA (on average), which was similar to the result of Example 3.

As described above, in the image display apparatus according to the embodiment of the invention, a reduction in a leakage current flowing through a non-selected device has been achieved, and thus a reduction in power consumption has been achieved.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-258014 filed Oct. 3, 2008, which is hereby incorporated by reference herein in its entirety.

What is claimed is:

1. An electron beam apparatus comprising:

an insulating member having a recess formed in a surface thereof;

a gate disposed on the surface of the insulating member;

a cathode disposed on the surface of the insulating member, the cathode being located such that the cathode faces the gate via the recess; and an anode opposed to the cathode via the gate, wherein the recess has a step structure formed on a surface close to an edge where the cathode is located, wherein the step structure is a depression, and wherein an angle $\theta_1$ of a side wall, located closer to an opening of the recess, of the depression with respect to an imaginary plane extending over the depression from the surface of the recess satisfies a condition described below $$\theta_1 > \tan^{-1}(d/W)$$

where d denotes a distance from an edge, on the same side as that where the cathode is located, of the recess to the gate, and W denotes a distance from the edge of the recess to the depression.

2. An electron beam apparatus comprising:

an insulating member having a recess formed in a surface thereof;

a gate disposed on the surface of the insulating member;

a cathode disposed on the surface of the insulating member, the cathode being located such that the cathode faces the gate via the recess; and an anode opposed to the cathode via the gate, wherein the recess has a step structure formed on a surface close to an edge where the cathode is located, wherein the step structure is a protrusion, and wherein an angle $\theta_2$ of a back-side side wall of the protrusion in the recess with respect to a bottom plane of the protrusion satisfies a condition described below $$\theta_2 > \tan^{-1}\{(d-h)/(W+S_2+(S_1-S_2)/2)\}$$

where d denotes a distance from an edge, on the same side as that where the cathode is located, of the recess to the gate, W denotes a distance from the edge of the recess to the protrusion, S1 denotes a width of the bottom plane of the protrusion, and S2 denotes a width of the upper plane of the protrusion.

3. An image display apparatus including an electron beam apparatus according to claim 1 and a light emission part disposed on the anode.

4. An image display apparatus including an electron beam apparatus according to claim 2 and a light emission part disposed on the anode.

* * * * *